US007275679B2

(12) United States Patent
Ingalls

(10) Patent No.: US 7,275,679 B2
(45) Date of Patent: Oct. 2, 2007

(54) MULTI-PLY CORRUGATED CONTAINERS, SUCH AS BULK BINS, AND FITMENT RETAINERS, SUCH AS DRAIN FITMENT RETAINERS USABLE WITH BULK BINS

(75) Inventor: Samuel L. Ingalls, Longview, WA (US)

(73) Assignee: Longview Fibre Company, Longview, WA (US)

( * ) Notice: Subject to any disclaimer, the term of this patent is extended or adjusted under 35 U.S.C. 154(b) by 169 days.

(21) Appl. No.: 10/950,166

(22) Filed: Sep. 23, 2004

(65) Prior Publication Data

US 2005/0051560 A1 Mar. 10, 2005

Related U.S. Application Data

(62) Division of application No. 10/051,891, filed on Jan. 16, 2002, now abandoned.

(51) Int. Cl.
*B65D 3/00* (2006.01)
*B65D 5/56* (2006.01)
*B65D 5/00* (2006.01)

(52) U.S. Cl. ..... 229/117.33; 229/939; 229/117.27; 229/109; 229/117.3

(58) Field of Classification Search ..... 229/117.27, 229/117.3, 122.21, 122.33, 939, 117.16, 117.29, 229/117.31, 125.22, 103.2, 143, 117.34, 122.27
See application file for complete search history.

(56) References Cited

U.S. PATENT DOCUMENTS

| | | | | |
|---|---|---|---|---|
| 1,154,688 | A | 9/1915 | Bale | |
| 1,758,230 | A | 5/1930 | Lange | |
| 1,865,688 | A | 7/1932 | Hannaford | |
| 1,959,193 | A | 5/1934 | Boeye | |
| 2,711,282 | A * | 6/1955 | Esposito | 229/125.29 |
| 3,122,300 | A | 2/1964 | Bombard | |
| 3,227,322 | A | 1/1966 | Crain | |
| 3,559,867 | A | 2/1971 | Muskopf | |
| 3,744,702 | A | 7/1973 | Ellison | |
| 3,873,017 | A | 3/1975 | Blatt | |
| 3,910,482 | A | 10/1975 | Bamburg et al. | |
| 4,441,948 | A | 4/1984 | Gillard | |
| 4,601,407 | A | 7/1986 | Gillard | |
| 4,693,413 | A | 9/1987 | McFarland | |
| 4,742,951 | A | 5/1988 | Kelly | |
| 4,850,506 | A | 7/1989 | Heaps | |
| RE33,128 | E | 12/1989 | Nordstrom | |
| 5,050,775 | A | 9/1991 | Marquardt | |
| 5,279,423 | A | 1/1994 | Shuert | |
| 5,353,982 | A | 10/1994 | Perkins et al. | |

(Continued)

*Primary Examiner*—Tri M. Mai
(74) *Attorney, Agent, or Firm*—Perkins Coie LLP

(57) ABSTRACT

Corrugated container assemblies, such as bulk bins, that include corrugated container bodies and drain fitment retainers. In one embodiment, a corrugated container assembly includes a rectangular corrugated container body having a bottom portion and a top portion. A rectangular liner tray is installed within the container body toward the bottom portion. A flexible and impervious liner is installed on the liner tray within the container body for containing liquid contents, and includes a drain fitment for dispensing the liquid contents. In one aspect of this embodiment, the container body includes a corner structure that can facilitate folding. In another aspect of this embodiment, the liner tray includes a fitment retainer that can accessibly position the drain fitment and at least restrict the drain fitment from moving or rotating.

30 Claims, 8 Drawing Sheets

U.S. PATENT DOCUMENTS

| | | | | |
|---|---|---|---|---|
| 5,489,061 | A | 2/1996 | Fogle | |
| 5,497,939 | A | 3/1996 | Heiskell | |
| 5,749,489 | A | 5/1998 | Benner | |
| 5,803,346 | A | 9/1998 | Baker | |
| 5,813,562 | A | 9/1998 | Perkins | |
| 5,938,108 | A | 8/1999 | Williams | |
| 5,941,452 | A | 8/1999 | Williams | |
| 6,000,549 | A | 12/1999 | Perkins | |
| 6,138,903 | A | 10/2000 | Baker | |
| 6,193,148 | B1 | 2/2001 | Shimada | |
| 6,250,542 | B1 * | 6/2001 | Negelen | 229/117.16 |

* cited by examiner

MULTI-PLY CORRUGATED CONTAINERS, SUCH AS BULK BINS, AND FITMENT RETAINERS, SUCH AS DRAIN FITMENT RETAINERS USABLE WITH BULK BINS

CROSS REFERENCE TO RELATED APPLICATIONS

This application is a divisional of U.S. patent application Ser. No. 10/051,891, filed Jan. 16, 2002 now abandoned, which is hereby incorporated by reference in its entirety.

TECHNICAL FIELD

This invention relates generally to corrugated containers and, more particularly, to corner structures and fitment retainers usable in connection with bulk bin corrugated containers.

BACKGROUND

Conventional paperboard boxes and corrugated containers are often rectangular or octagonal in shape and typically have enclosed bottom portions formed by overlapping flaps. The top portions of such containers may be left open or may be enclosed by similar overlapping flaps or by a separate top cover. Panels on corrugated containers are often constructed of multi-wall corrugated paperboard materials laminated together to meet applicable strength requirements. For example, some heavy-duty corrugated containers for transporting bulk materials have side panels constructed of two or more plies, with each ply including two or more corrugations. Containers of this nature are commonly referred to as "bulk bins," and are often used to store and transport liquids or granular substances. When used to hold a liquid, a flexible and impervious liner is typically installed inside the bulk bin to contain the liquid and protect the paperboard material from liquid-related damage. This liner will often incorporate a drain fitment that extends through an opening in the lower portion of the bulk bin in such a way that a user can access the fitment to dispense the liquid contents from the bulk bin.

Bulk bins offer certain advantages that metallic containers, such as 55-gallon drums, do not offer. For example, in addition to being recyclable, bulk bins can also be "knocked down" into a substantially flat configuration for ease of storage or shipment, and then resurrected later for use. In the case of a rectangular bulk bin, knocking it down will typically involve removing or deconstructing any top or bottom closures and then compressing two opposite corners of the bulk bin together to thereby flatten the structure. Consequently, in the knocked-down configuration, two opposing corners of the bulk bin will form substantially open angles while the other two corners will form substantially closed angles.

One common problem with conventional bulk bins, however, is that they are often difficult to knock down flat, having a tendency to spring back into a partially erect configuration that is undesirable for storage or transport. One attempt to alleviate this spring back problem is disclosed in U.S. Pat. No. 4,441,948 to Gillard, et al. Gillard discloses a bulk bin that is manufactured by winding corrugated sheet material on a large, rotating, rectangular-shaped forming mandrel. As the corrugated material is wound, a shoe-plate compresses the material toward the mandrel as each corner of the mandrel passes. The result is a bulk bin having compressed material in each corner that allegedly offers less knock down resistance than conventional bulk bins. One shortcoming associated with the bulk bin disclosed in Gillard, however, is the complex manufacturing equipment it requires. In contrast to the conventional manufacturing equipment used to make flat blanks of corrugated material for use in conventional bulk bins, Gillard requires a large, rotating forming mandrel capable of winding corrugated materials into large box-like structures.

Another attempt to develop a multi-ply corrugated container that is easily knocked down to a flat configuration is disclosed in U.S. Pat. No. 6,138,903 to Baker. Baker discloses a multi-ply corrugated container having a rectangular cross-sectioned inner tubular shell concentrically disposed within a rectangular cross-sectioned outer tubular shell. Adjacent walls of the inner and outer shells are offset from each other to form spaces in between in which rectangular panels of corrugated material are inserted and bonded to the adjacent walls. Because the rectangular panels do not extend to the corners, this construction results in gaps between the inner and outer shells at each corner of the container. The corrugations of the inner and outer shells are additionally compressed at each corner so that, apparently, the container can be easily knocked down to a flat configuration without a substantial amount of spring-back.

A further problem often associated with bulk bins for holding liquids is the tendency for the drain fitment to move or rotate during movement of the bulk bin or filling of the liner. Such movement can cause the drain fitment to bear against the periphery of the fitment opening in the bulk bin often resulting in damage to the drain fitment or the liner. In addition, the structural integrity of the bulk bin may be compromised by creasing or breakage of the corrugated panel adjacent to the fitment opening.

A number of fitment retainers attempting to overcome this problem are disclosed in U.S. Pat. No. Re. 33,128 to Nordstrom, U.S. Pat. No. 5,749,489 to Benner, et al., and U.S. Pat. No. 5,803,346 to Baker, et al. In general, these fitment retainers are formed in an end cap structure that encloses the bottom of the bulk bin, and they typically include a fitment aperture of some type intended to prevent the fitment from migrating or rotating during use.

SUMMARY

The present disclosure describes multi-ply corrugated containers, such as bulk bins, that can be knocked down for storage or transport when not in use. The present disclosure further describes fitment retainers, such as drain fitment retainers usable with bulk bin drain fitments, that can at least restrict drain fitment movement or rotation during movement of the bulk bin or filling of the liner. In one aspect of the invention, a foldable corrugated container structure can include an outer laminate forming at least a first outer panel and a second outer panel and having a first score line offset from a second score line by a first offset distance. The first and second score lines can be at least generally interposed between the first and second outer panels. The foldable corrugated container structure can further include an inner laminate forming at least a first inner panel and a second inner panel and having a third score line offset from a fourth score line by a second offset distance. The third and fourth score lines can be at least generally interposed between the first and second inner panels. In a further aspect of the invention, the inner laminate can be at least partially bonded to the outer laminate with the first inner panel positioned adjacent to the first outer panel to form a first wall, the second inner panel positioned adjacent to the second outer panel to form a second wall, and the first and second score lines of the outer laminate positioned adjacent to the third and fourth score lines of the inner laminate to define a corner portion. In yet a further aspect of the invention, the first and second walls can be foldable toward each other about the corner portion.

In another aspect of the invention, a liner tray usable with a liner that includes a drain fitment for dispensing liquids can include a planar base member and a first fitment retainer panel foldably extending from the base member along a first fold line. The first fitment retainer panel can include a first fitment aperture shaped and sized to receive the drain fitment. A second fitment retainer panel can foldably extend from the first fitment retainer panel along a second fold line that is at least approximately parallel to the first fold line, and the second retainer panel includes a second fitment aperture shaped and sized to receive the drain fitment. In a further aspect of the invention, the second fitment retainer panel can be foldable about the second fold line to position the second fitment aperture adjacent to the first fitment aperture. A third fitment retainer panel can foldably extend from the second fitment retainer panel along a third fold line that is at least approximately perpendicular to the first and second fold lines, and the third fitment retainer can include a third fitment aperture shaped and sized to receive the drain fitment. In a further aspect of the invention, the third fitment retainer panel can be foldable about the third fold line to position the third fitment aperture adjacent to the first and second fitment apertures.

DETAILED DESCRIPTION

The present disclosure describes multi-ply corrugated containers and drain fitment retainers usable with such containers. Many specific details of certain embodiments of the invention are set forth in the following description and in FIGS. 1-11 to provide a thorough understanding of these embodiments. Those of ordinary skill in the relevant art will understand, however, that the present invention may have additional embodiments, and that the invention may be practiced without several of the details described below. In other instances, structures, processes, and functions well known to those of ordinary skill in the relevant art have not been shown or described in detail to avoid unnecessarily obscuring the description of the embodiments of the invention.

Figure 1:
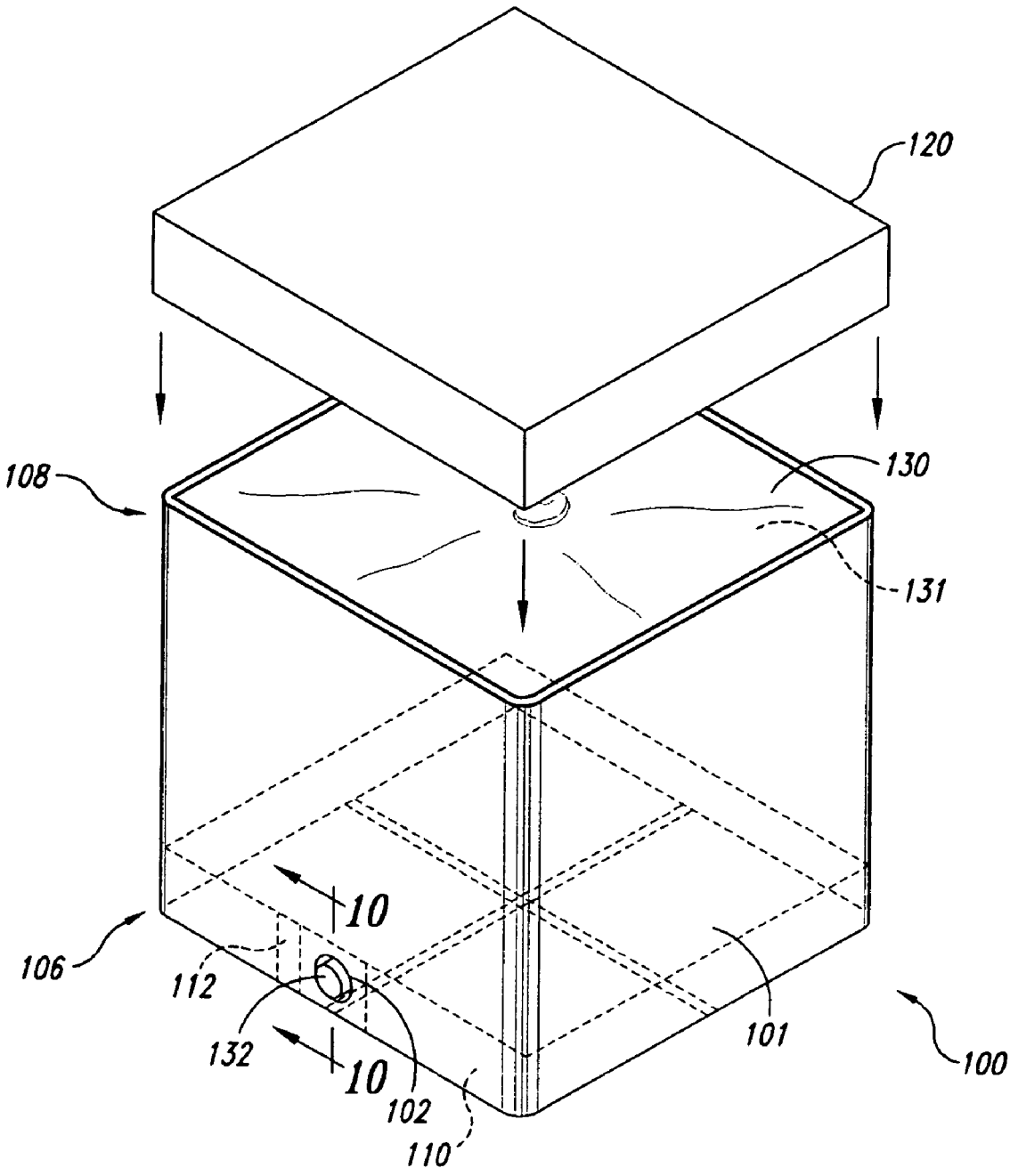
FIG. 1 is an isometric view of a corrugated container assembly in accordance with an embodiment of the invention.

FIG. 1 is an isometric view of a corrugated container assembly 100 in accordance with an embodiment of the invention. In one aspect of this embodiment, the corrugated container assembly 100 includes a corrugated container body, such as a rectangular corrugated container body 101, having a bottom portion 106 and a top portion 108. A liner tray, such as a rectangular liner tray 110, is installed within the container body 101 toward the bottom portion 106. In a further aspect of this embodiment, the liner tray 110 can be constructed of noncorrugated paperboard. In other embodiments, the liner tray 110 can be constructed of other materials, such as corrugated paperboard. A flexible and impervious liner 130 is installed on the liner tray 110 within the container body 101 and contains liquid contents 131. A cap member 120 is positionable over the top portion 108 of the container body 101 to enclose the top portion.

The liner 130 of the illustrated embodiment includes a drain fitment 132 that extends through a fitment opening 102 in the bottom portion 106 of the container body 101. The drain fitment 132 is optionally changeable between a closed configuration in which the liquid contents 131 of the liner 130 are retained and an open configuration in which the liquid contents are allowed to drain. As will be described in greater detail below, the liner tray 110 includes a fitment retainer 112 that holds the drain fitment 132 adjacent to the fitment opening 102 and at least restricts the drain fitment from migrating and rotating relative to the fitment opening.

Although the container assembly 100 depicted in FIG. 1 is rectangular, those of ordinary skill in the relevant art will appreciate that aspects of the present invention disclosed herein are equally applicable to corrugated containers having other shapes. In an alternate embodiment, for example, the aspects disclosed can be applied to a corrugated container having an octagonal shape. Indeed, it is contemplated that the aspects of the present invention described below for producing an easily foldable corner portion can be extended to virtually any corrugated structure. Thus, although embodiments of the present invention are described throughout this disclosure with reference to a rectangular corrugated container for purposes of illustration, this disclosure should not be construed as limited to this particular container shape.

Figure 2A:
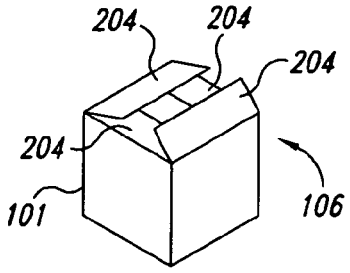
FIGS. 2A-2H are a series of isometric views illustrating a representative sequence for using the corrugated container assembly of FIG. 1 in accordance with an embodiment of the invention.
Figure 2B:
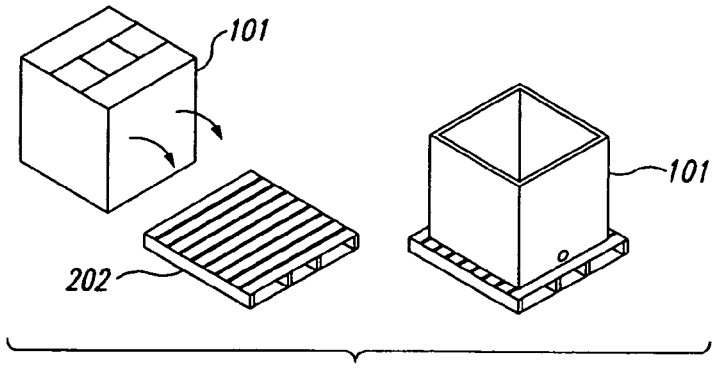
Figure 2C:
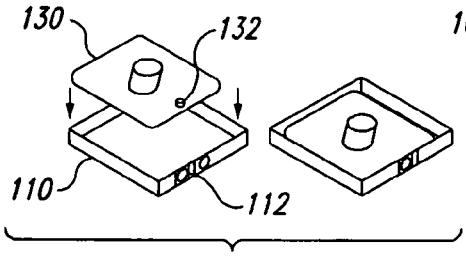
Figure 2D:
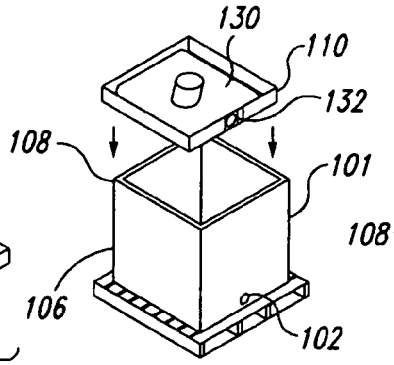

FIGS. 2A-2H are a series of isometric views illustrating a representative sequence for using the corrugated container assembly 100 of FIG. 1 in accordance with embodiment of the invention. In FIG. 2A, the container body 101 is inverted and bottom flaps 204 are folded inwardly to partially enclose the bottom portion 106 of the container body. In FIG. 2B, the inverted container body 101 is rotated upright and placed on a pallet 202. In FIG. 2C, the liner 130 is placed in the liner tray 110 and the drain fitment 132 is engaged with the fitment retainer 112. In FIG. 2D, the liner tray 110 and the liner 130 are inserted as an assembly through the top portion 108 of the container body 101 and moved into position adjacent to the bottom portion 106. When properly positioned, the drain fitment 132 extends at least partially through the fitment opening 102.

Figure 2E:
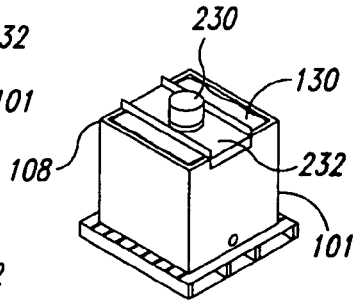
Figure 2F:
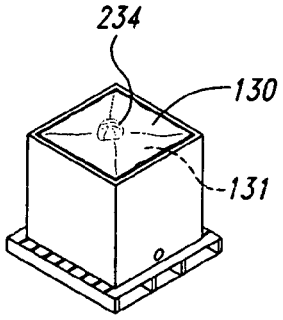
Figure 2G:
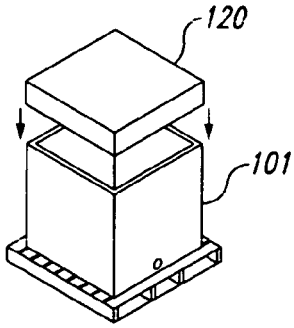
Figure 2H:
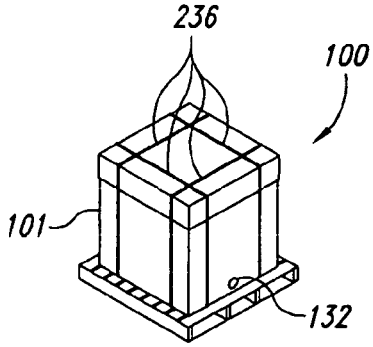

In FIG. 2E, the liner 130 is prepared for filling with the aid of a fill station 232 that includes a cylindrical chimney 230. The fill station 232 is positioned across the open top portion 108 of the container body 101 and the liner 130 is pulled up and through the chimney 230 and splayed over the chimney to form an inlet through which the liner can be filled. In FIG. 2F, the liner 130 is first filled with the liquid contents 131, such as concentrated fruit juice or nonregulated chemicals, and the liner is then closed using a suitable closing device 234, such as a tie wrap. In FIG. 2G, the cap member 120 is placed over the top portion 108 of the container body 101. As illustrated in FIG. 2H, one or more straps 236 can be used to secure the cap member 120 to the container body 101. Accordingly, the filled container assembly 100 is now ready for transportation or storage. As will be described in greater detail below, when the liquid contents 131 are to be drained, a user (not shown) opens the drain fitment 132 until the desired quantity has been dispensed, at which time the user closes the drain fitment.

Figure 3:
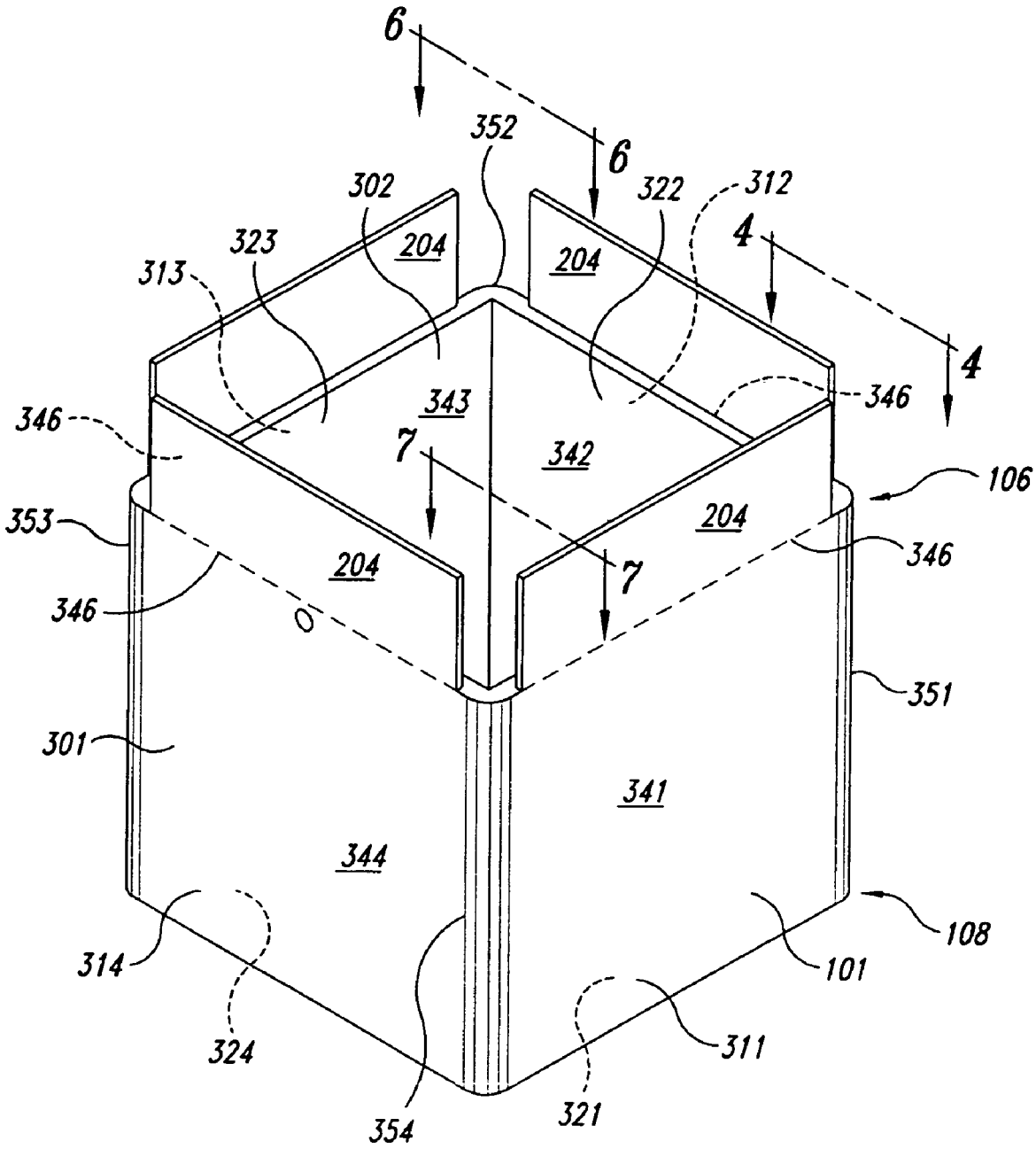
FIG. 3 is an isometric view of a container body of the corrugated container assembly of FIG. 1 shown in an inverted orientation in accordance with an embodiment of the invention.

FIG. 3 is an isometric view of the container body 101 of FIG. 1 in accordance with an embodiment of the invention. The container body 101 is inverted in FIG. 3 for purposes of illustration. In one aspect of this embodiment, the container body 101 can include an outer laminate, or outer tube 301, and an inner laminate, or inner tube 302. In a further aspect of this embodiment, the inner and outer tubes 302 and 301 can be bonded to each other to enhance the strength of the container body 101. In other embodiments, the inner tube 302 or the outer tube 301 can be omitted and the container body 101 can accordingly be constructed from a single tube. In yet other embodiments, the container body 101 can include three or more tubes. For example, the container body 101 can include the inner tube 302, the outer tube 301, and a mid tube (not shown) sandwiched between the inner and outer tubes. Accordingly, those of ordinary skill in the relevant art will understand that aspects of the present invention extend beyond the representative embodiment of FIG. 3.

The outer tube 301 includes a first outer side panel 311, a second outer side panel 312, a third outer side panel 313, and a fourth outer side panel 314. The inner tube 302 is sleeved within the outer tube 301 and similarly includes a first inner side panel 321, a second inner side panel 322, a third inner side panel 323, and a fourth inner side panel 324. Corresponding inner and outer side panels are positioned adjacent to each other in one-to-one correspondence to form a first container sidewall 341, a second container sidewall 342, a third container sidewall 343, and a fourth container sidewall 344. The first container sidewall 341 is foldably connected to the second container sidewall 342 by a first corner portion 351; the second container sidewall 342 is foldably connected to the third container sidewall 343 by a second corner portion 352; the third container sidewall 343 is foldably connected to the fourth container sidewall 344 by a third corner portion 353; and the fourth container sidewall 344 is foldably connected to the first container sidewall by a fourth corner portion 354. The container body 101 further includes the four bottom flaps 204. Each bottom flap 204 extends from one of the adjacent outer side panels 311-314, and is foldably connected to the adjacent outer side panel along a fold line 346. As mentioned above with reference to FIG. 2, when preparing the container body 101 for use, the bottom flaps 204 are folded inwardly along the fold lines 346 to at least partially enclose the bottom portion 106 of the container body.

Figure 4:
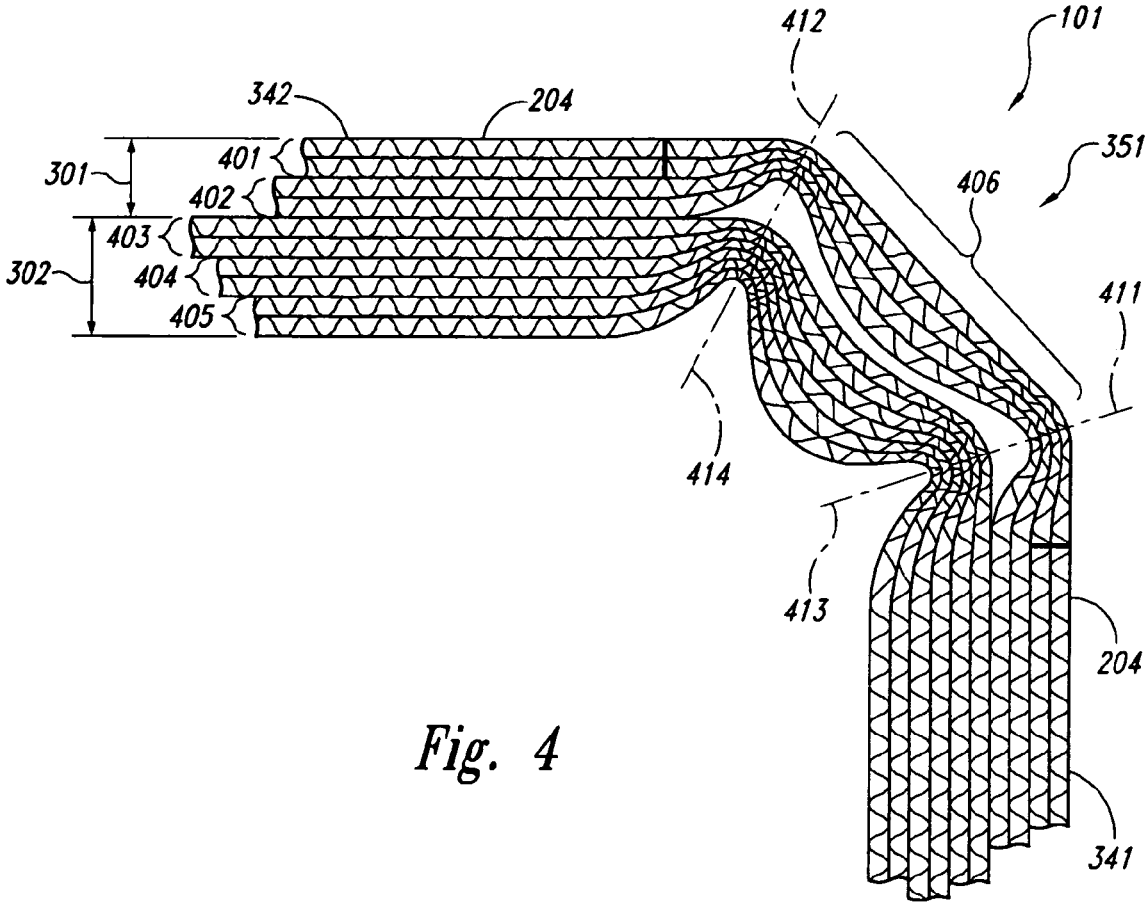
FIG. 4 is an enlarged end view of a corner portion of the container body of FIG. 3 taken substantially along line 44 in FIG. 3 in accordance with an embodiment of the invention.

FIG. 4 is an enlarged end view of the first corner portion 351 taken substantially along line 4-4 in FIG. 3 in accordance with an embodiment of the invention. In one aspect of this embodiment, the outer tube 301 can include a first ply 401 laminated to a second ply 402. In a further aspect of this embodiment, the inner tube 302 can include a third ply 403 laminated to a fourth ply 404 and a fifth ply 405. In the illustrated embodiment, all the plies 401-405 are constructed of double-wall corrugated paperboard, and the bottom flaps 204 are extensions of the first ply 401. In other embodiments, the plies 401-405 can be constructed of other corrugated materials without departing from the spirit or scope of the present invention.

In another aspect of this embodiment, the outer tube 301 can include a first score line 411 offset from a second score line 412, and the inner tube 302 can include a third score line 413 offset from a fourth score line 414. Each of the score lines 411-414 can be produced by compressing the adjacent corrugated material along a substantially straight line to thereby reduce the material thickness along the line. In one embodiment, for example, the score lines 411-414 can be relatively narrow score lines produced with a score tool (not shown) having a relatively narrow scoring surface, such as a scoring surface with a radius of approximately 0.25 inch or less. In one aspect of this embodiment, using narrow score lines result in a favorable folding configuration when the corner portion 351 is folded inwardly. In other embodiments, the score lines 411-414 can be other types of score lines produced using other types of score tools.

The outer and inner tubes 301 and 302 are bonded together with adhesive between the second and third plies 402 and 403 to increase the structural integrity of the container body 101 (FIG. 3). In one aspect of this embodiment, however, no adhesive is applied in a nonbonded region 406 adjacent to the score lines 411-414 to facilitate folding. Indeed, a gap may exist at times between the outer and inner tubes 301 and 302 in the nonbonded region 406. In other embodiments, for example, where the inner and outer tubes 302 and 301 are laminated together before scoring, adhesive may be applied to the entire region between the second and third plies 402 and 403 including the nonbonded region 406.

One advantage of the present invention is associated with the score lines 411-414. The score lines 411-414 can facilitate folding the first sidewall 341 toward the second sidewall 342 by offering little resistance as the first and second sidewalls are brought together. As a result, the container body 101 of FIG. 3 can be easily knocked down to a flattened configuration for storage or transport when not in use. In addition, the configuration of the corner portion 351 illustrated in FIG. 4 reduces the tension in the first ply 401 when the corner portion is folded inwardly. This reduction in tension avoids rupturing or tearing the first ply 401 which may compromise the structural integrity of the container body 101 or at least have an unfavorable appearance. As a further advantage, the corner portion 351 illustrated in FIG. 4 can be produced using conventional corrugated container manufacturing equipment, in contrast to some prior art bulk bins which may require large, rotating mandrels or similar specialized equipment.

In alternate embodiments, the container body 101 can have ply arrangements other than those described above with reference to FIG. 4. For example, the outer and inner tubes 301 and 302 may have more or fewer plies, and these plies may be constructed of corrugated materials other than double-wall. For instance, in one such alternate embodiment, both the outer and inner tubes 301 and 302 can have two plies, with each ply being constructed of triple-wall corrugated paperboard. As mentioned above with reference to FIG. 3, in another alternate embodiment, either the inner tube 302 or the outer tube 301 can be omitted resulting in a container body having a single tube with a first score line offset from a second score line by a first offset distance in each corner portion of the single tube.

As those of ordinary skill in the relevant art can appreciate, various score line configurations may be utilized to form corner portions in accordance with this disclosure without departing from the spirit or scope of the present invention. For example, although the score lines 411-414 of FIG. 3 are formed on the inner sides of the respective tubes 301 and 302, in alternate embodiments these score lines can be formed on the outer sides of the respective tubes and still provide the advantages associated with the present invention.

Figure 5:
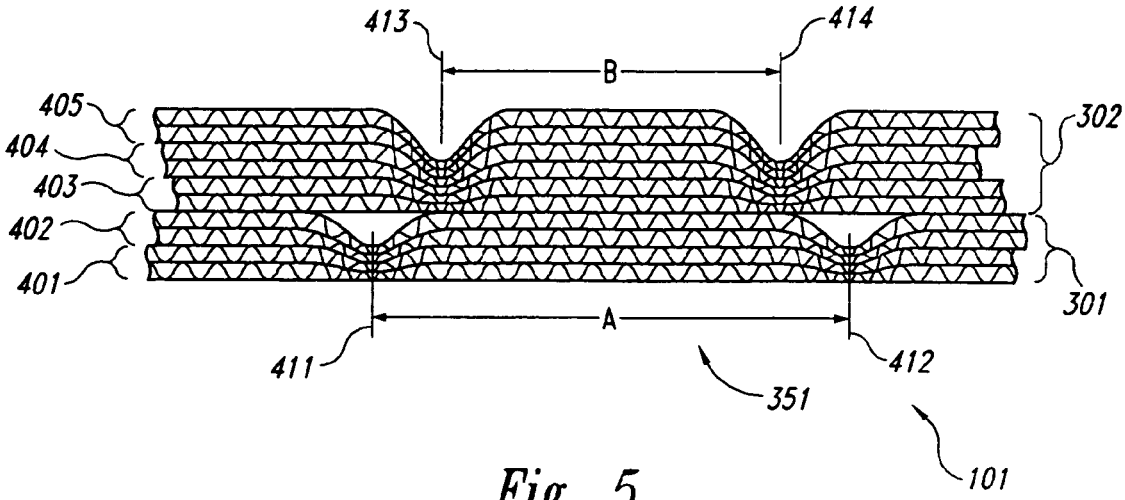
FIG. 5 illustrates the corner portion of FIG. 4 in a flat configuration in accordance with an embodiment of the invention.

FIG. 5 illustrates the corner portion 351 of FIG. 4 in a flat configuration for the purpose of illustrating aspects of the score lines 411-414 in accordance with an embodiment of the invention. While the inner tube 302 is shown laying flat on the outer tube 301 for purposes of illustration, those of ordinary skill in the relevant art will understand that in practice the corner portion 351 may look slightly different than FIG. 5 when the corner portion is unfolded. For example, in practice the inner and outer tubes 302 and 301 may be slightly kinked and spaced apart from each other by a gap adjacent to the corner portion 351 when the corner portion is unfolded. In one aspect of this embodiment, the first score line 411 is offset from the second score line 412 by a first offset distance A, and the third score line 413 is offset from the fourth score line 414 by a second offset distance B. In the illustrated embodiment, the first offset distance A is greater than the second offset distance B. In other embodiments, the first offset distance A can be equal to the second offset distance B. Setting the first offset distance A on the outer tube 301 greater than or equal to the second offset distance B on the inner tube 302 can result in a favorable ply configuration when the container body 101 is folded about the corner portion 351.

In a further aspect of this embodiment, the first offset distance A and the second offset distance B can be determined using equations (1) and (2), respectively, below:

$$A = 0.30\times(\text{thickness of the outer tube } \mathbf{301}) + 2\times(\text{thickness of the inner tube } \mathbf{302}) \quad (1)$$

$$B = 1.54\times(\text{thickness of the inner tube } \mathbf{302}) \quad (2)$$

An example can explain the use of equations (1) and (2) to determine the offset distances A and B. For this example, assume that the first ply 401 and the second ply 402 of the outer tube 301, and the fifth ply 405 of the inner tube 302, each have a thickness of approximately 0.37 inch. Further assume that the third and fourth plies 403 and 404 of the inner tube 302 each have a thickness of approximately 0.38 inch. Based on these assumptions, the outer tube 301 has a thickness of approximately 0.74 inch and the inner tube 302 has a thickness of approximately 1.13 inches. Inserting these thicknesses into equation (1) above results in the first offset distance A being approximately equal to 2.5 inches. Similarly, inserting the thickness for the inner tube 302 into equation (2) above results in the second offset distance B being approximately equal to 1.7 inches.

Using equations (1) and (2) above to determine the first and second offset distances A and B is but one approach and should not be considered exhaustive. For example, in an alternate embodiment, the second offset distance B can be set equal to the combined thickness of the inner and outer tubes 302 and 301, and the first offset distance A can be set equal to 1.3× the combined thickness of the inner and outer tubes 302 and 301. Using this alternate approach and the ply thicknesses from above, the first offset distance A will be approximately equal to 2.4 inches and the second offset distance B will be approximately equal to 1.9 inches. Accordingly, those of ordinary skill in the relevant art will appreciate that other approaches exist for determining the first and second offset distances A and B in accordance with this disclosure.

Figure 6:
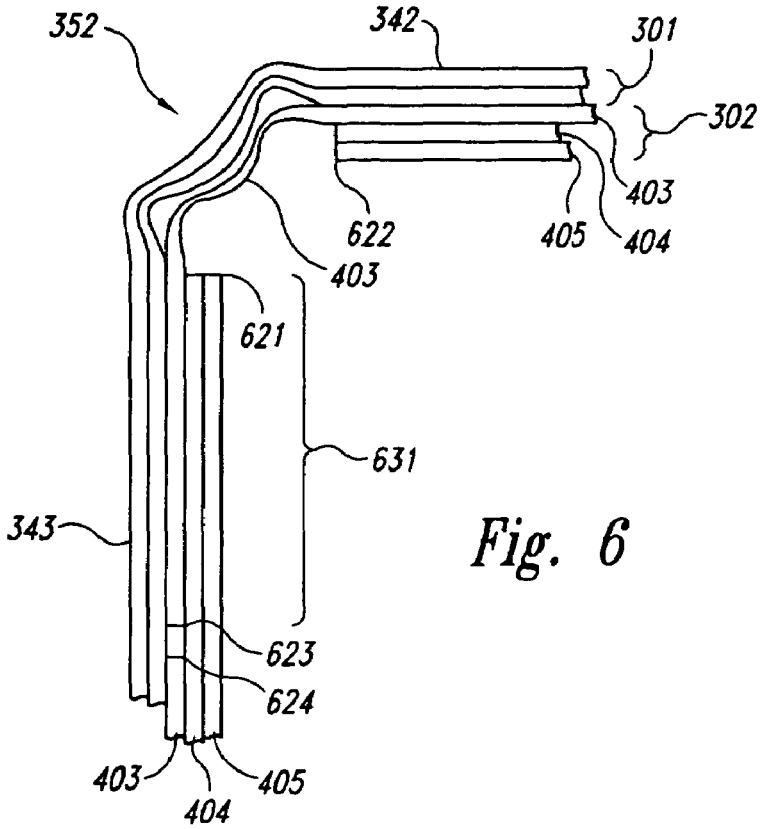
FIG. 6 is an enlarged end view of another corner portion of the container body of FIG. 3 taken substantially along line 6-6 in FIG. 3 in accordance with an embodiment of the invention.
Figure 7:
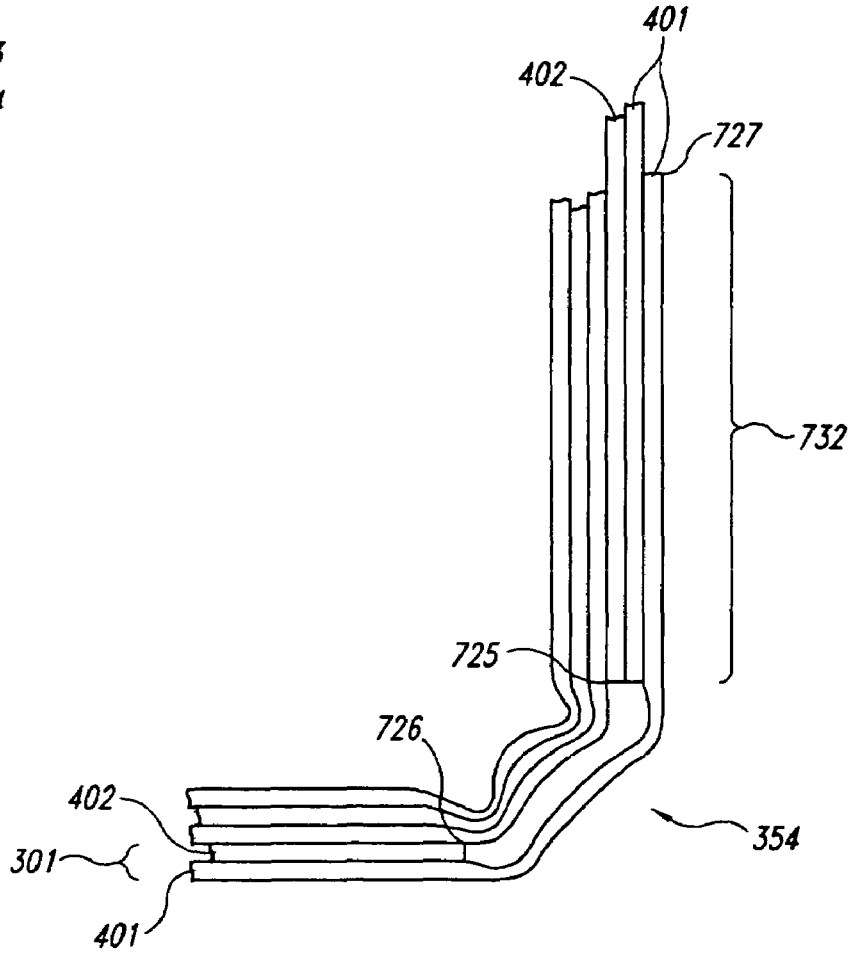
FIG. 7 is an enlarged end view of yet another corner portion of the container body of FIG. 3 taken substantially along line 7-7 in FIG. 3 in accordance with an embodiment of the invention.

FIG. 6 is an enlarged end view of the second corner portion 352 taken substantially along line 6-6 in FIG. 3, and FIG. 7 is an enlarged end view of the fourth corner portion 354 taken substantially along line 7-7 in FIG. 3. FIGS. 6 and 7 together illustrate aspects of lap-joints usable in connection with the inner and outer tubes 302 and 301, respectively, in accordance with an embodiment of the invention. Referring first to FIG. 6, the fourth and fifth plies 404 and 405 of the inner tube 302 define a first edge 621 and a second edge 622. The third ply 403 of the inner tube 302 defines a third edge 623 and a fourth edge 624. The third and fourth edges 623 and 624 are offset from the first edge 621 to define a first lap-joint 631. Bonding the third ply 403 to the fourth ply 404 in the first lap-joint 631 gives the inner tube 302 its tubular shape. As will be apparent to those of ordinary skill in the relevant art, the first lap-joint 631 illustrated in FIG. 6 is but one technique for forming the inner tube 302, and in other embodiments, other techniques can be used.

Referring now to FIG. 7, the first and second plies 401 and 402 of the outer tube 301 define a fifth edge 725, and the second ply 402 defines a sixth edge 726. The first ply 401 extends beyond the sixth edge 726 to define a seventh edge 727. The seventh edge 727 is offset from the fifth edge 725 to define a second lap-joint 732. Bonding the first ply 401 to itself in the second lap-joint 732 gives the outer tube 301 its tubular shape. As will be apparent to those of ordinary skill in the relevant art, the second lap-joint 732 illustrated in FIG. 7 is but one technique for forming the outer tube 301, and in other embodiments, a number of different techniques for creating lap-joints can be used.

Figure 8:
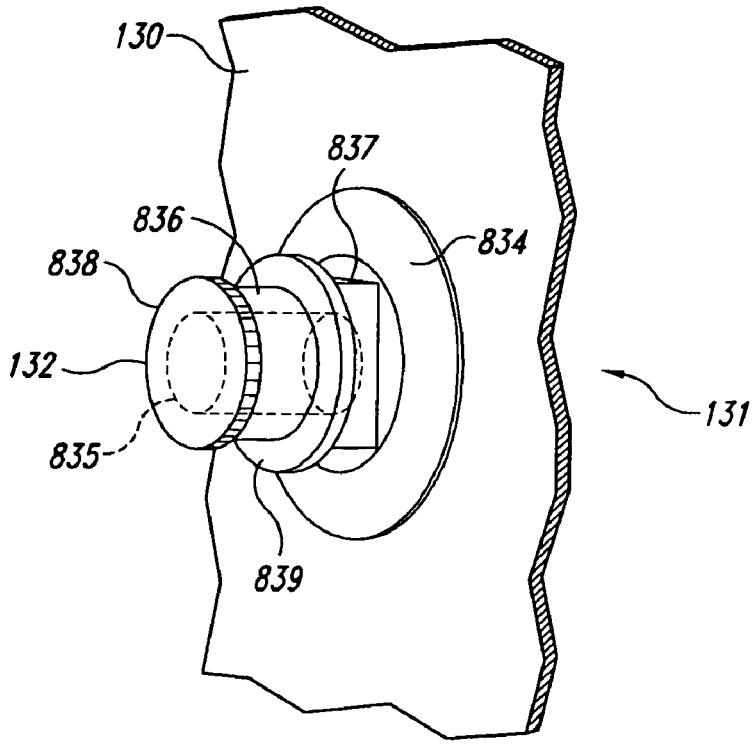
FIG. 8 is an enlarged isometric view of a drain fitment of the corrugated container assembly of FIG. 1 in accordance with an embodiment of the invention.

FIG. 8 is an enlarged isometric view of the drain fitment 132 of FIG. 1 in accordance with an embodiment of the invention. In one aspect of this embodiment, the drain fitment 132 can include a base 834 sealably attached to the liner 130, a hollow neck 836 extending from the base to an opening 835, and a drain plug 838 threadably received in the opening 835. In a further aspect of this embodiment, the neck 836 can include an oversized flange 839 spaced apart from the base 834, and a rectangular cross-section portion 837 in the space between the flange and the base. In the illustrated embodiment, the rectangular cross-section portion 837 has a square cross-section, and the flange 839 has a circular cross-section that is at least partially larger than the square cross-section of the rectangular cross-section portion. In other embodiments, the neck 836 can include an octagonal cross-section portion in the space between the flange 839 and the base 834. In still other embodiments, the space between the flange 839 and the base 834 can have other cross-sections.

The drain fitment 132 is used to drain a desired quantity of the liquid contents 131 from the liner 130 in one embodiment as follows: First, a user (not shown) unthreads the drain plug 838 from the opening 835 and inserts a valve (also not shown) in its place. As the valve is threaded into the opening 835, a portion of the valve punctures a part of the liner 130 that is blocking the neck 836 adjacent to the base 834, permitting a portion of the liquid contents 131 to flow into the neck. Once the valve has been fully installed, the user may turn a knob on the valve in a first direction to open the valve and dispense the liquid contents 131 out of the liner 130 via the opening 835 in the drain fitment 132. After the desired quantity of the liquid contents 131 is drained, the user turns the knob a second direction opposite to the first direction to close the valve and stop the flow. As will be appreciated by those of skill in the relevant art, in other embodiments, other valves can be used in other ways to drain a desired quantity of the liquid contents 131 from the liner 130.

Figure 9A:
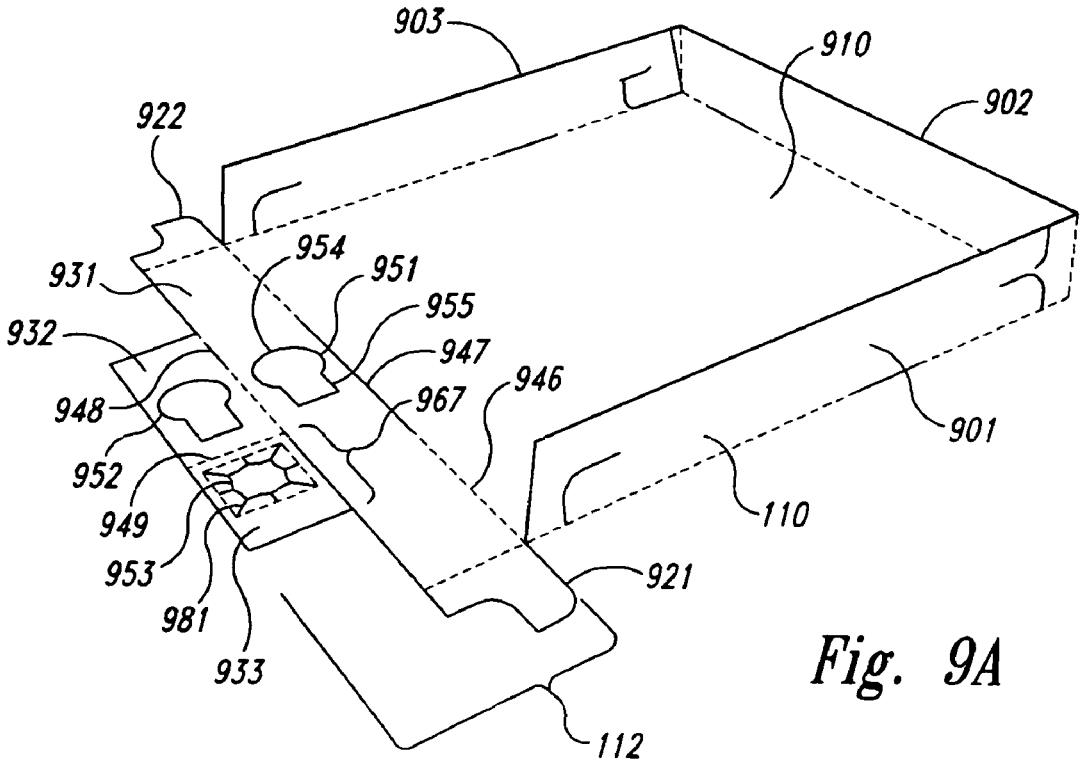
FIG. 9A is an enlarged isometric view of a liner tray of the corrugated container assembly of FIG. 1 in a partially assembled configuration in accordance with an embodiment of the invention.
Figure 9B:
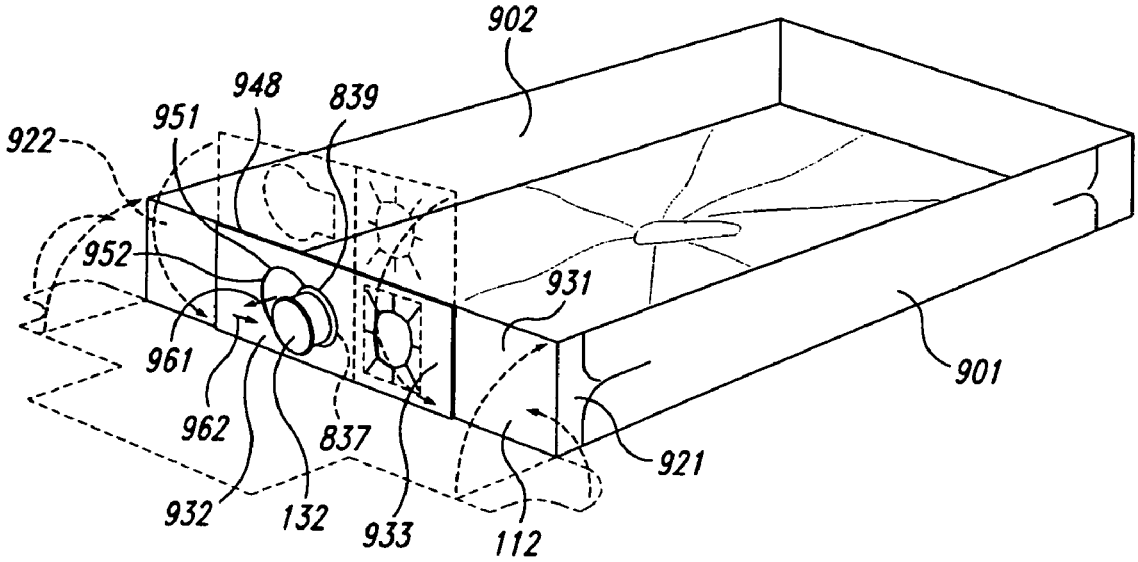
FIGS. 9B and 9C are enlarged isometric views of the liner tray and the drain fitment of the corrugated container assembly of FIG. 1 in different stages of assembly in accordance with an embodiment of the invention.
Figure 9C:
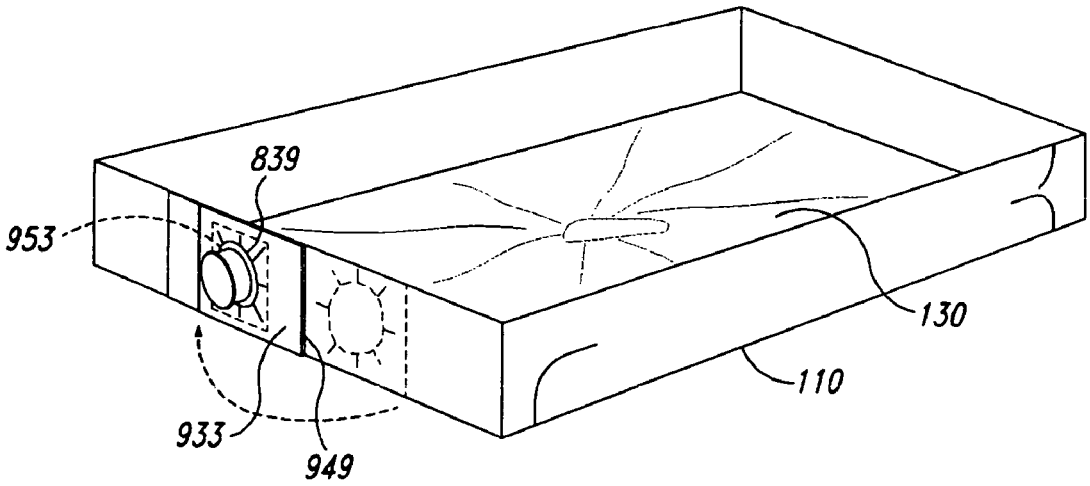

FIG. 9A is an enlarged isometric view of the liner tray 110 of FIG. 1 in a partially assembled configuration. FIGS. 9B and 9C are enlarged isometric views of the liner tray 110 and the drain fitment 132 of FIG. 1 in different stages of assembly. Together, FIGS. 9A-9C illustrate aspects of the liner tray 110 and the fitment retainer 112 in accordance with an embodiment of the invention. Referring first to FIG. 9A, in one aspect of this embodiment, the liner tray 110 can include a base member 910, a first side member 901, a second side member 902, and a third side member 903. The first, second and third side members 901-903 foldably extend from the base member 910 and interlock with each other to form three sides of the liner tray 110 as shown. In a further aspect of this embodiment, the liner tray 110 includes the fitment retainer 112, which foldably extends from the base member 910 along a first fold line 946. The fitment retainer 112 can include first and second interlocking members 921 and 922. When the fitment retainer 112 is rotated upwardly about the first fold line 946, the first and second interlocking members 921 and 922 can interlock with the first and third side members 901 and 903, respectively, to form a fourth side of the liner tray 110.

In one aspect of this embodiment, the fitment retainer 112 can include a first fitment retainer panel 931, a second fitment retainer panel 932, and a third fitment retainer panel 933. The first fitment retainer panel 931 foldably extends from the base member 910 along the first fold line 946 and includes a first fitment aperture 951. In the illustrated embodiment, the first fitment aperture 951 has a keyhole shape that includes an oversize portion 954 and an engagement portion 955. The oversize portion 954 is shaped and sized to permit passage of the flange 839 (FIG. 8) of the drain fitment 132 (FIG. 8). Accordingly, the circular shape illustrated in FIG. 9A is one possible embodiment of the oversize portion 954. In other embodiments, other shapes, such as square shapes, can be used. The engagement portion 955 is shaped and sized to snugly receive the rectangular cross-section portion 837 of the drain fitment 132 and restrain the drain fitment from rotating during use. For example, in one embodiment, the engagement portion 955 restrains the drain fitment from rotating when, as explained above with reference to FIG. 8, the user removes the drain plug 838 or turns the valve installed in its place. Accordingly, the engagement portion 955 of the illustrated embodiment has a generally rectangular shape. In other embodiments, the engagement portion 955 can have other shapes suitable for snugly receiving the rectangular cross-sectioned portion 837 and restraining the drain fitment 132.

In one aspect of this embodiment, a relief slit 947 is at least substantially aligned with the first fold line 946 and extends through the liner tray 110 adjacent to the first fitment aperture 951. As will be explained in greater detail below, the relief slit 947 can reduce the tendency of the drain fitment 132 to rotate downwardly when the drain fitment is engaged in the fitment retainer 112 and the liner 130 (not shown) is full or partially full of the liquid contents 131 (also not shown).

In another aspect of this embodiment, the second fitment retainer panel 932 foldably extends from the first fitment retainer panel 931 along a second fold line 948 and includes a second fitment aperture 952. In the illustrated embodiment, the second fitment aperture 952 is substantially similar in shape and size to the first fitment aperture 951. The third fitment retainer panel 933 foldably extends from the second fitment retainer panel 932 along a third fold line 949, and is separated from the first fitment retainer panel 931 by a separation slit 967. The third fitment retainer panel 933 includes a third fitment aperture 953 and a plurality of slits 981 extending radially from the third fitment aperture. In the illustrated embodiment, the third fitment aperture is shaped and sized to releasably snap into place over the flange 839 of the drain fitment 132 of FIG. 8, and accordingly has a generally rectangular shape with the slits 981 extending diagonally from the corners of the aperture and perpendicularly from the sides. In other embodiments, the third fitment aperture 953 can have other shapes. For example, the third fitment aperture in one alternate embodiment can have a generally circular shape with slits that extend from the aperture in a starburst pattern.

Installation of the drain fitment 132 in the fitment retainer 112 will now be described with reference to FIGS. 9B and 9C in accordance with an embodiment of the invention. Referring first to FIG. 9B, the fitment retainer 112 has been rotated to a vertical position and the first and second interlocking members 921 and 922 are interlocked with the first and second side members 901 and 902, respectively. Further, the second and third fitment retainer panels 932 and 933 have been rotated downwardly along the second fold line 948 so that the second fitment aperture 952 is adjacent to, and at least substantially aligned with, the first fitment aperture 951. In this configuration, the drain fitment 132 is extended in a first direction 961 through the oversize portions of the first and second fitment apertures 951 and 952 such that the flange 839 of the drain fitment is positioned outboard of the first and second fitment retainer panels 931 and 932. The drain fitment 132 is then moved laterally in a second direction 962 so that the rectangular cross-sectioned portion 837 of the drain fitment is received by the engagement portions of the first and second fitment apertures 951 and 952, as illustrated in FIG. 9B.

As shown in FIG. 9C, the third fitment retainer panel 933 is now rotated about the third fold line 949 until the third fitment aperture 953 snaps into place over the flange 839 of the drain fitment 132. As shown in FIGS. 2A-2H and described above, the liner tray 110 and the liner 130 can now be inserted as an assembly through the top portion 108 of the container body 101 and moved into position adjacent to the bottom portion 106 in preparation for filling the liner.

In other embodiments, the liner tray 110 can have shapes other than the rectangular shape illustrated in FIGS. 9A-9C. For example, the liner tray 110 can have an octagonal shape when used with an octagonal container body (not shown). In yet other embodiments, the liner tray 110 can have other shapes as required to accommodate particular applications without departing from the spirit or scope of the present invention.

Figure 10:
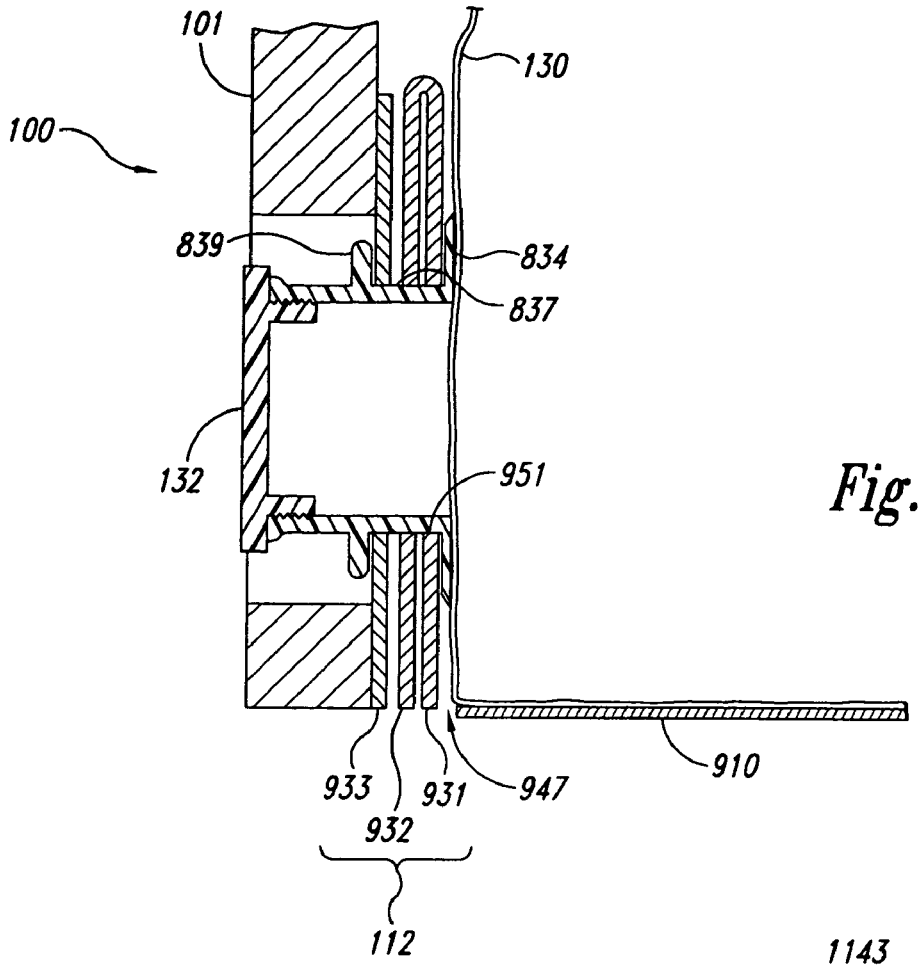
FIG. 10 is an enlarged cross-sectional view of the drain fitment and fitment retainer of FIG. 1 taken substantially along line 10-10 in FIG. 1 in accordance with an embodiment of the invention.

FIG. 10 is an enlarged cross-sectional view taken substantially along line 10-10 in FIG. 1 for the purpose of further illustrating aspects of the fitment retainer 112 in accordance with an embodiment of the invention. As shown in FIG. 10, each of the first, second, and third fitment retainer panels 931-933 is sandwiched between the base 834 and the flange 839 of the drain fitment 132 when the drain fitment is engaged with the fitment retainer 112. Also shown in FIG. 10 is how the relief slit 947 separates the first fitment retainer panel 931 from the base member 910 adjacent to the first fitment aperture 951. Separating the first fitment retainer panel 931 from the base member 910 in this region reduces the tendency for the fitment retainer panel 931, and hence the drain fitment 132, to rotate downwardly with respect to the base member 910 about the first fold line 946 (FIG. 9A) when liquid contents (not shown) cause the liner 130 to bulge outwardly. In one aspect of this embodiment, this feature may advantageously prevent breakage of the drain fitment 132 or rupturing of the liner 130 which could occur as a result of rotation of the drain fitment.

Figure 11:
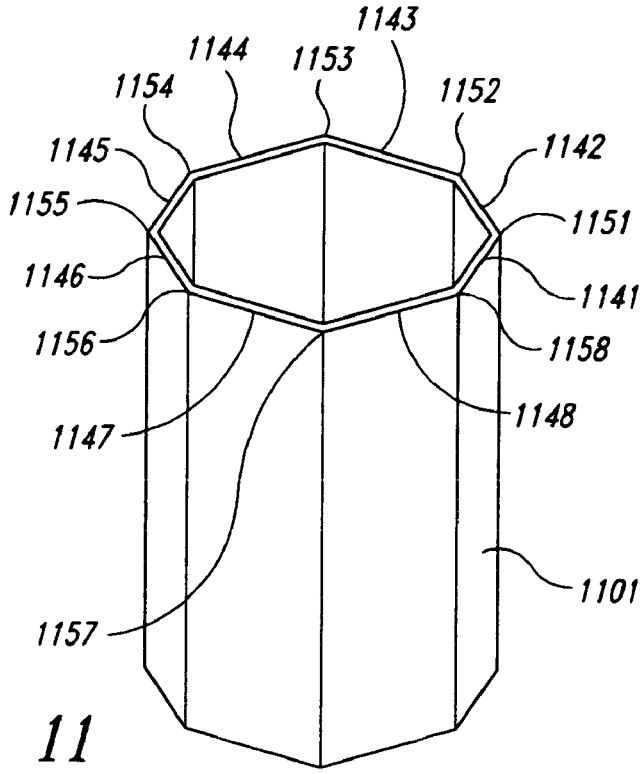
FIG. 11 is an isometric view of a container body in accordance with another embodiment of the invention.

FIG. 11 is an isometric view of a container body 1101 in accordance with another embodiment of the invention. In one aspect of this embodiment, the container body 1101 is an octagonal container body including a first container sidewall 1141, a second container sidewall 1142, a third container sidewall 1143, a fourth container sidewall 1144, a fifth container sidewall 1145, a sixth container sidewall 1146, a seventh container sidewall 1147, and an eighth container sidewall 1148. The first container sidewall 1141 is foldably connected to the second container sidewall 1142 by a first corner portion 1151; the second container sidewall 1142 is foldably connected to the third container sidewall 1143 by a second corner portion 1152; the third container sidewall 1143 is foldably connected to the fourth container sidewall 1 144 by a third corner portion 1153; the fourth container sidewall 1144 is foldably connected to the fifth container sidewall 1145 by a fourth corner portion 1154, the fifth container sidewall 1145 is foldably connected to the sixth container sidewall 1146 by a fifth corner portion 1155, the sixth container sidewall 1146 is foldably connected to the seventh container sidewall 1147 by a sixth corner portion 1156, the seventh container sidewall 1147 is foldably connected to the eighth container sidewall 1148 by a seventh corner portion 1157, and the eighth container sidewall 1148 is foldably connected to the first container sidewall 1141 by an eighth corner portion 1154.

In one aspect of this embodiment, the container body 1101 can be substantially similar to the container body 101 described above with reference to FIGS. 1-10. Accordingly, the corner portions 1151-1158 can be substantially similar to the corner portion 351 shown in FIG. 4, and the sidewalls 1141-1148 of the container body 1101 can include multiple tubes or may include only a single tube. Further, the container body 1101 can also be used in connection with a corrugated container assembly (not shown) that is substantially similar to the corrugated container assembly 100 described above with reference to FIGS. 1-10.

From the foregoing, those of ordinary skill in the relevant art will appreciate that, although specific embodiments of the invention have been described herein for purposes of illustration, various modifications may be made without deviating from the spirit and scope of the invention. For example, as explained above, embodiments of the present invention can be used in accordance with this disclosure for corrugated containers other than multi-ply bulk bins, such as single-ply corrugated containers that are generally smaller in stature. Accordingly, the invention is not limited, except as by the appended claims.

I claim:

1. A liner tray usable with a liner for holding liquids, the liner including a drain fitment for dispensing the liquids, the drain fitment having a neck portion and a flange adjacent to the neck portion, the liner tray comprising:

a base member; and a fitment retainer foldably connected to the base member, the fitment retainer including first, second, and third fitment apertures, the first and second fitment apertures each having an oversize portion and an engagement portion, the oversize portions being shaped and sized to permit passage of the flange of the drain fitment, the first and second fitment apertures being positionable in at least approximate alignment with each other, the third fitment aperture being positionable in at least approximate alignment with the engagement portions of the first and second fitment apertures, wherein the neck portion of the drain fitment has a cross-sectional shape and the engagement portions of the first and second fitment apertures and the third fitment aperture have at least partially the same cross-sectional shape as the neck portion, and wherein the engagement portions of the first and second fitment apertures and the third fitment aperture are shaped and sized to receive and engage the neck portion of the drain fitment.

2. The liner tray of claim 1 wherein the fitment retainer further includes a plurality of slits extending radially from the third fitment aperture sized to allow the third fitment aperture to pass over the flange of the drain fitment and releasably receive the neck portion of the drain fitment.

3. The liner tray of claim 1 wherein the base member and the fitment retainer are fabricated from non-corrugated paperboard.

4. The liner tray of claim 1 wherein the third fitment aperture has a generally rectangular shape, and wherein a slit extends diagonally from each corner of the third fitment aperture and a slit extends perpendicularly from each side of the third fitment aperture.

5. The liner tray of claim 1 wherein the neck portion of the drain fitment has a rectangular cross-section.

6. The liner tray of claim 1 wherein the fitment retainer foldably extends from the base member along a fold line, wherein the first and second fitment apertures are foldably positionable in at least approximate alignment with each other, and wherein the third fitment aperture is foldably positionable in at least approximate alignment with the engagement portions of the first and second fitment apertures.

7. A liner tray usable with a liner for holding liquids, the liner including a drain fitment for dispensing the liquids, the drain fitment having a neck portion and a flange adjacent to the neck portion, the liner tray comprising:

a base member;

a fitment retainer extending from the base member along a fold line, the fitment retainer including first, second, and third fitment apertures, the first and second fitment apertures each having an oversize portion and an engagement portion, the oversize portions being shaped and sized to permit passage of the flange of the drain fitment and the engagement portions being shaped and sized to receive the neck portion of the drain fitment, the first and second fitment apertures being positionable in at least approximate alignment with each other, the third fitment aperture being shaped and sized to releasably receive the neck portion of the drain fitment, the third fitment aperture being positionable in at least approximate alignment with the engagement portions of the first and second fitment apertures; and a relief slit at least approximately aligned with the fold line and adjacent to the first fitment aperture.

8. A liner tray usable with a liner for holding liquids, the liner including a drain fitment for dispensing the liquids, the liner tray comprising:

a base member;

a first fitment retainer panel foldably connected to the base member along a first fold line, the first fitment retainer panel having a first fitment aperture shaped and sized to receive the drain fitment;

a second fitment retainer panel foldably connected to the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel foldably connected to the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures, and wherein the drain fitment has a cross-sectional shape and the first, second, and third fitment apertures have at least partially the same cross-sectional shape as the drain fitment.

9. The liner tray of claim 8 wherein the base member and the first, second, and third fitment retainer panels are fabricated from non-corrugated paperboard.

10. The liner tray of claim 8 wherein the drain fitment includes a neck portion and a flange adjacent to the neck portion, wherein:

the first and second fitment apertures each have an oversize portion and an engagement portion, the oversize portions being shaped and sized to permit passage of the flange of the drain fitment and the engagement portions being shaped and sized to receive and engage the neck portion of the drain fitment; and the third fitment aperture is shaped and sized to releasably receive the neck portion of the drain fitment, the third fitment aperture being positionable in at least approximate alignment with the engagement portions of the first and second fitment apertures.

11. The liner tray of claim 10 wherein the neck portion of the drain fitment has a rectangular cross-section.

12. A liner tray usable with a liner for holding liquids, the liner including a drain fitment for dispensing the liquids, the drain fitment having a neck portion and a flange adjacent to the neck portion, the liner tray comprising:

a base member; and a fitment retainer extending from the base member, the fitment retainer including first, second, and third fitment apertures, the first and second fitment apertures each having an oversize portion and an engagement portion, the oversize portions being shaped and sized to permit passage of the flange of the drain fitment and the engagement portions being shaped and sized to receive the neck portion of the drain fitment, the first and second fitment apertures being positionable in at least approximate alignment with each other, the third fitment aperture being shaped and sized to releasably receive the neck portion of the drain fitment, the third fitment aperture being positionable in at least approximate alignment with the engagement portions of the first and second fitment apertures, wherein the first and second fitment apertures have keyhole shapes.

13. A liner tray usable with a liner for holding liquids, the liner including a drain fitment for dispensing the liquids, the liner tray comprising:

a base member;

a first fitment retainer panel extending from the base member along a first fold line, the first fitment retainer panel having a first fitment aperture shaped and sized to receive the drain fitment;

a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel extending from the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures, wherein the third fitment retainer panel further includes a plurality of slits extending radially from the third fitment aperture sized to allow the third fitment aperture to pass over at least a portion of the drain fitment.

14. A liner tray usable with a liner for holding liquids, the liner including a drain fitment for dispensing the liquids, the liner tray comprising:

a base member;

a first fitment retainer panel extending from the base member along a first fold line, the first fitment retainer panel having a first fitment aperture shaped and sized to receive the drain fitment;

a relief slit at least approximately aligned with the first fold line and adjacent to the first fitment aperture;

a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel extending from the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures.

15. A liner tray usable with a liner for holding liquids, the liner including a drain fitment for dispensing the liquids, the liner tray comprising:

a base member;

a first fitment retainer panel extending from the base member along a first fold line, the first fitment retainer panel having a first fitment aperture shaped and sized to receive the drain fitment;

a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel extending from the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures, and wherein the first and second fitment apertures have keyhole shapes.

16. A liner tray usable with a liner for holding liquids, the liner including a drain fitment for dispensing the liquids, the liner tray comprising:

a base member;

a first fitment retainer panel extending from the base member along a first fold line, the first fitment retainer panel having a first fitment aperture shaped and sized to receive the drain fitment;

a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel extending from the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures, wherein the third fitment aperture has a generally rectangular shape, and wherein a slit extends diagonally from each corner of the third fitment aperture and a slit extends perpendicularly from each side of the third fitment aperture.

17. The liner tray of claim 16 wherein the first and second fitment apertures have keyhole shapes.

18. A method for producing a liner tray usable with a liner for holding liquids, the liner including a drain fitment for dispensing the liquids, the drain fitment having a neck portion and a flange adjacent to the neck portion, the neck portion having a cross-sectional shape, the method comprising:

forming a base member;

forming a fitment retainer foldably connected to the base member;

forming first and second fitment apertures in the fitment retainer, the first and second fitment apertures each having an oversize portion and an engagement portion, the oversize portions being shaped and sized to permit passage of the flange of the drain fitment, the engagement portions being shaped and sized to receive and engage the neck portion of the drain fitment, the engagement portions having at least partially the same cross-sectional shape as the neck portion, the first and second fitment apertures being positionable in at least approximate alignment with each other; and forming a third fitment aperture in the fitment retainer, the third fitment aperture being shaped and sized to releasably receive the neck portion of the drain fitment, the third fitment aperture having at least partially the same cross-sectional shape as the neck portion, the third fitment aperture being positionable in at least approximate alignment with the engagement portions of the first and second fitment apertures.

19. The method of claim 18 further comprising forming a plurality of slits in the fitment retainer extending radially from the third fitment aperture sized to allow the third fitment aperture to pass over the flange of the drain fitment and releasably receive the neck portion of the drain fitment.

20. The method of claim 18 wherein forming the third fitment aperture includes forming the third fitment aperture having a generally rectangular shape, and wherein the method further comprises forming a slit extending diagonally from each corner of the third fitment aperture and forming a slit extending perpendicularly from each side of the third fitment aperture.

21. The method of claim 18 wherein forming the base member and forming the fitment retainer include forming the base member and forming the fitment retainer from noncorrugated paperboard.

22. A method for producing a liner tray usable with a liner for holding liquids, the liner including a drain fitment for dispensing the liquids, the drain fitment having a neck portion and a flange adjacent to the neck portion, the method comprising:

forming a base member;

forming a fitment retainer extending from the base member along a fold line;

forming first and second fitment apertures in the fitment retainer, the first and second fitment apertures each having an oversize portion and an engagement portion, the oversize portions being shaped and sized to permit passage of the flange of the drain fitment and the engagement portions being shaped and sized to receive and engage the neck portion of the drain fitment, the first and second fitment apertures being positionable in at least approximate alignment with each other;

forming a third fitment aperture in the fitment retainer, the third fitment aperture being shaped and sized to releasably receive the neck portion of the drain fitment, the third fitment aperture being positionable in at least approximate alignment with the engagement portions of the first and second fitment apertures; and forming a relief slit at least approximately aligned with the fold line and adjacent to the first fitment aperture.

23. A method for producing a liner tray usable with a liner for holding liquids, the liner including a drain fitment for dispensing the liquids, the drain fitment having a neck portion and a flange adjacent to the neck portion, the method comprising:

forming a base member;

forming a fitment retainer extending from the base member;

forming first and second fitment apertures in the fitment retainer, each of the first and second fitment apertures having a keyhole shape with an oversize portion and an engagement portion, the oversize portions being shaped and sized to permit passage of the flange of the drain fitment and the engagement portions being shaped and sized to receive and engage the neck portion of the drain fitment, the first and second fitment apertures being positionable in at least approximate alignment with each other; and forming a third fitment aperture in the fitment retainer, the third fitment aperture being shaped and sized to releasably receive the neck portion of the drain fitment, the third fitment aperture being positionable in at least approximate alignment with the engagement portions of the first and second fitment apertures.

24. A liner tray usable with a liner for holding liquids, the liner including a drain fitment for dispensing the liquids, the liner tray comprising:

a base member;

a fitment retainer extending from the base member along a first fold line, at least a portion of the fitment retainer being configured to receive the drain fitment, wherein the fitment retainer includes:

a first fitment retainer panel extending from the base member along the first fold line, the first fitment retainer panel having a first fitment aperture shaped and sized to receive the drain fitment; and a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture, wherein the first and second fitment apertures have keyhole shapes; and a relief slit at least approximately aligned with the first fold line adjacent to the portion of the fitment retainer configured to receive the drain fitment.

25. The liner tray of claim 24 wherein the drain fitment includes a neck portion with a cross-sectional shape, and wherein at least a portion of the first fitment aperture has the same cross-sectional shape as the neck portion of the drain fitment.

26. A liner tray usable with a liner for holding liquids, the liner including a drain fitment for dispensing the liquids, the liner tray comprising:

a base member;

a fitment retainer extending from the base member along a first fold line, at least a portion of the fitment retainer being configured to receive the drain fitment, wherein the fitment retainer includes:

a first fitment retainer panel extending from the base member along the first fold line, the first fitment retainer panel having a first fitment aperture shaped and sized to receive the drain fitment;

a second fitment retainer panel extending from the first fitment retainer panel along a second fold line that is at least approximately parallel to the first fold line, the second retainer panel having a second fitment aperture shaped and sized to receive the drain fitment, the second fitment retainer panel being foldable about the second fold line to position the second fitment aperture adjacent to the first fitment aperture; and a third fitment retainer panel extending from the second fitment retainer panel along a third fold line that is at least approximately perpendicular to the first and second fold lines, the third fitment retainer having a third fitment aperture shaped and sized to receive the drain fitment, wherein the third fitment retainer panel is foldable about the third fold line to position the third fitment aperture adjacent to the first and second fitment apertures; and a relief slit at least approximately aligned with the first fold line adjacent to the portion of the fitment retainer configured to receive the drain fitment.

27. The liner tray of claim 26 wherein the third fitment retainer panel further includes a plurality of slits extending radially from the third fitment aperture sized to allow the third fitment aperture to pass over at least a portion of the drain fitment.

28. The liner tray of claim 26 wherein the drain fitment includes a neck portion and a flange adjacent to the neck portion, wherein:

the first and second fitment apertures each have an oversize portion and an engagement portion, the oversize portions being shaped and sized to permit passage of the flange of the drain fitment and the engagement portions being shaped and sized to receive and engage the neck portion of the drain fitment; and the third fitment aperture is shaped and sized to releasably receive the neck portion of the drain fitment, the third fitment aperture being positionable in at least approximate alignment with the engagement portions of the first and second fitment apertures.

29. The liner tray of claim 28 wherein the first and second fitment apertures have keyhole shapes and the third fitment aperture has a generally rectangular shape, and wherein a slit extends diagonally from each corner of the third fitment aperture and a slit extends perpendicularly from each side of the third fitment aperture.

30. The liner tray of claim 28 wherein the neck portion of the drain fitment has a rectangular cross-section.

* * * * *

UNITED STATES PATENT AND TRADEMARK OFFICE

CERTIFICATE OF CORRECTION

PATENT NO. : 7,275,679 B2
APPLICATION NO. : 10/950166
DATED : October 2, 2007
INVENTOR(S) : Samuel L. Ingalls It is certified that error appears in the above-identified patent and that said Letters Patent is hereby corrected as shown below:

In column 3, line 44, delete “44” and insert -- 4-4 --, therefor.

Signed and Sealed this

Twelfth Day of May, 2009

JOHN DOLL
*Acting Director of the United States Patent and Trademark Office*